US005611154A

United States Patent [19]

Lucchetta et al.

[11] Patent Number: 5,611,154

[45] Date of Patent: Mar. 18, 1997

[54] WATERTIGHT SKI BOOT

[75] Inventors: Faustino Lucchetta, Treviso; Silvano Barbisan, Covolo di Piave, both of Italy

[73] Assignee: Nordica S.p.A., Trevignano, Italy

[21] Appl. No.: 632,717

[22] Filed: Apr. 15, 1996

Related U.S. Application Data

[63] Continuation of Ser. No. 198,740, Feb. 18, 1994, abandoned.

[30] Foreign Application Priority Data

Mar. 17, 1993 [IT] Italy ..... TY93A0028

[51] Int. Cl.[6] ..... A43B 5/04

[52] U.S. Cl. ..... 36/50.5; 36/117.1

[58] Field of Search ..... 36/50.5, 50.1, 36/7.3, 4, 97, 54, 117.1

[56] References Cited

U.S. PATENT DOCUMENTS

| | | | |
|---|---|---|---|
| 347,653 | 8/1886 | Sloan | 36/4 |
| 470,183 | 3/1892 | Dorr | 36/50.1 |
| 899,978 | 9/1908 | Hessler | 36/50.1 |
| 2,433,228 | 12/1947 | L'Hollier | 36/7.3 |
| 4,974,346 | 12/1990 | Marega . | |

FOREIGN PATENT DOCUMENTS

| | | | |
|---|---|---|---|
| 0517219 | 12/1992 | European Pat. Off. . | |
| 0572775 | 12/1993 | European Pat. Off. . | |
| 0352464 | 8/1905 | France | 36/50.1 |
| 990624 | 9/1951 | France . | |
| 1904847 | 8/1970 | Germany . | |
| 2062795 | 6/1972 | Germany | 36/50.5 |
| 0039445 | 3/1977 | Japan | 36/50.5 |

*Primary Examiner*—Ted Kavanaugh
*Attorney, Agent, or Firm*—Guido Modiano; Albert Josif

[57] ABSTRACT

Ski boot comprising a shell with overlapping flaps and improved watertightness. An elastically deformable tab is in fact provided on the lateral edge of at least one of the flaps and is partially or fully folded toward the other flap. This allows optimum tightness when the shell is secured and equally optimum tightness while walking, once sports activity has ended.

19 Claims, 3 Drawing Sheets

WATERTIGHT SKI BOOT

This is a continuation of application Ser. No. 08/198,740, filed on Feb. 18, 1994, now abandoned.

BACKGROUND OF THE INVENTION

The present invention relates to an improved watertight ski boot comprising a shell with overlapping flaps and in which watertightness is improved.

The problem of reducing the infiltration of water in the ski boots during sports practice is strongly felt: in the ski boot shells, the overlap of the flaps in fact does not eliminate the possibility of water infiltrations inside the boot.

The flaps are in fact made of relatively rigid material, and during use undergo mutual sliding movements that lead to the forming of small openings, especially along the edges of the flaps.

As a partial solution to these drawbacks it is known to apply a rubber or plastic block, especially at the transverse edges of the flaps, which has the purpose of creating a mechanical obstacle against the flow of water from the toe to the flaps during sports practice.

Watertight sealing devices are also known which are constituted by two separate inserts applied separately on different edges of the flaps of the shell; one of the two inserts is arranged at a longitudinal edge of a flap.

The second insert is in turn constituted by two parts: one is inserted at the transverse edges of the flaps of the shell, whereas the other one is associated transversely to the first one toward the toe of the ski boot.

Even this known solution, illustrated in Italian patent no. 1,039,942 filed on 18 July 1975, has drawbacks: first of all there are three components which must be partially assembled to one another and to the shell, and secondly the interaction of all these components with one another and with the flaps still does not ensure optimum watertightness between them.

In any case, all these solutions have the additional drawback of allowing considerable water infiltration once the shell closing levers have been disengaged, for example to allow the skier to walk.

In such conditions, the flaps no longer interact with one another, thus forming wide gaps for water infiltration.

SUMMARY OF THE INVENTION

An aim of the present invention is to solve the described technical problems, eliminating the drawbacks of the prior art and providing a ski boot which allows optimum tightness against water infiltrations in ski boots that comprise a shell with overlapping flaps.

Another object is to provide a ski boot which is structurally simple and equally simple to industrialize.

Another important object is to provide a ski boot which is reliable and safe in use and thus ensures watertightness both during sports practice and if the skier loosens the levers in order to walk.

Another object is to provide a ski boot having low manufacturing costs.

This aim, these objects and others which will become apparent hereinafter are achieved by an improved watertight ski boot, comprising a shell with overlapping flaps, characterized in that at least one of said flaps has an elastically deformable tab that is at least partially folded toward the other flap.

BRIEF DESCRIPTION OF THE DRAWINGS

Further characteristics and advantages of the present invention will become apparent from the following detailed description of some embodiments thereof, given by way of non-limitative example in the accompanying drawings, wherein.

DESCRIPTION OF THE PREFERRED EMBODIMENTS

Figure 1:
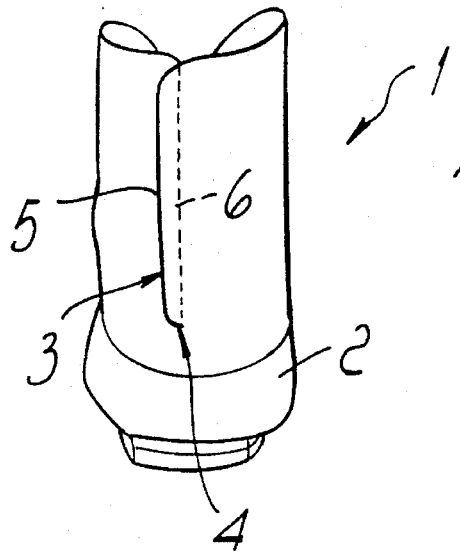
FIG. 1 is a front view of a ski boot with the shell provided with overlapping flaps.

With reference to the above figures, the reference numeral 1 designates the ski boot comprising a shell 2 provided with a first flap 3 and with a second flap 4 which mutually overlap in normal use while skiing by means of adapted levers, not shown in the figure.

Figure 2:
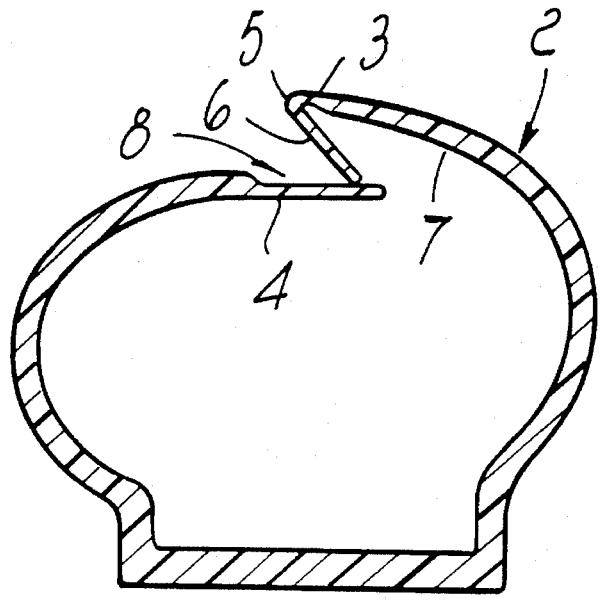
FIG. 2 is a cross section view of the shell.

As shown in FIG. 2, a tab 6 is formed on the lateral edge 5 of the first flap 3 and is folded toward the inside of the shell in the direction of the second flap 4.

The tab 6 forms, when inactive, an acute angle with the internal lateral surface 7 of the first flap 3.

When the first and second flaps overlap, once the necessary levers have been secured, the tab 6 can be partially or fully accommodated within an adapted seat 8 formed longitudinally with respect to the second flap 4.

The use of the invention is thus as follows: when the first and second flaps overlap, during sports practice, the tab 6 improves the seal between the first flap and the second flap by virtue of its deformability.

If the skier stops skiing and loosens the levers to walk, the unavoidable mutual separation of the lateral edges of the first and second flaps is compensated by the tab 6, which still interacts with the second flap and forms a sealing region again by virtue of its elastic deformation.

It has thus been observed that the invention has achieved the intended aim and objects, since a ski boot with overlapping flaps has been obtained in which tightness between said flaps is ensured both during sports practice and while walking.

The ski boot according to the invention is naturally susceptible to numerous modifications and variations, all of which are within the scope of the same inventive concept.

Thus, for example, a shell 102 is illustrated which has a first flap 103 and a second flap 104 that can mutually overlap.

An elastically deformable tab 106 protrudes toward the overlying first flap 103 at the lateral edge 105 of the second flap 104.

Said tab 106 forms an acute angle with the outer lateral surface 109 of the second flap 104, and its outward edge interacts with the inner lateral surface 107 of the first flap 102.

This second solution also allows to maintain excellent tightness while walking.

Figure 4:
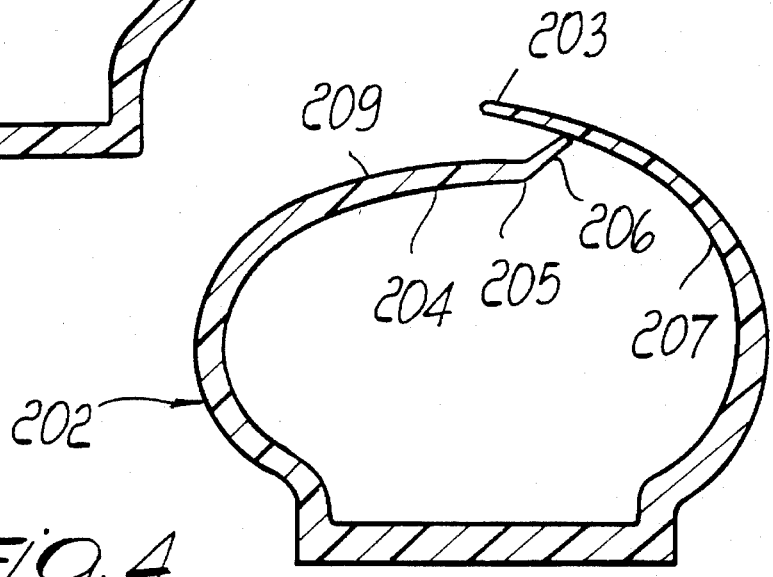

FIG. 4 illustrates a shell 202 comprising a first flap 203 and a second flap 204 that mutually overlap.

A tab 206 protrudes toward the first flap 203 at the lateral edge 205 of the second flap 204 and forms an obtuse angle with the outer lateral surface 209 of the second flap 204.

The outward edge of the tab 206 instead interacts with the inner lateral surface 207 of the first flap 203.

In this condition, too, the tab 206 is elastically deformable, in that its free edge tends to maintain contact with the inner lateral surface 207 of the first flap 203.

Figure 5:
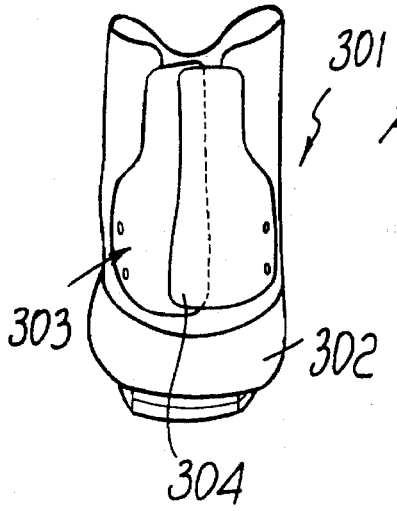
FIG. 5 is a front view of a ski boot according to a further aspect of the invention.
Figure 6:
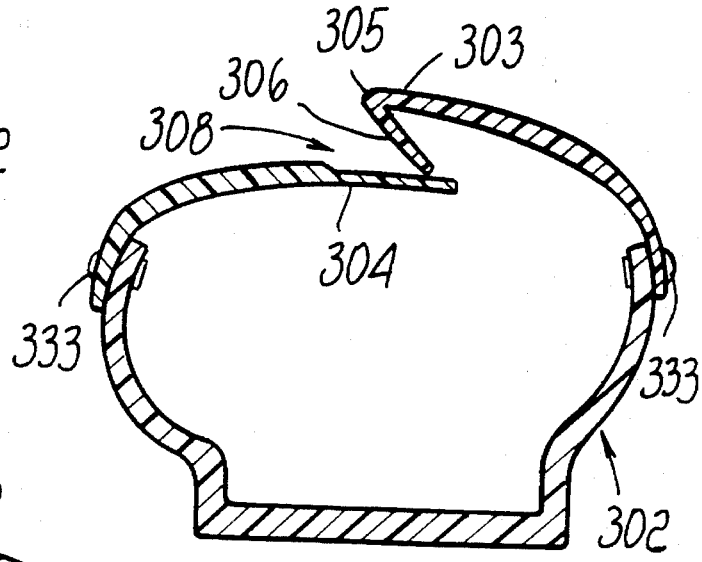
FIGS. 6–9 are cross section views of the shell according to different aspects of the invention.

FIGS. 5 and 6 illustrate a ski boot 301 wherein flaps 303 and 304 are not made integral with the shell but rather associated therewith by means of rivets 333.

The first flap 303 has a tab 306 formed at the edge 305 and, similarly to the embodiment illustrated in FIGS. 1 and 2, the tab 306 can be arranged in an adapted seat 308 provided at the second flap 304.

Figure 3:
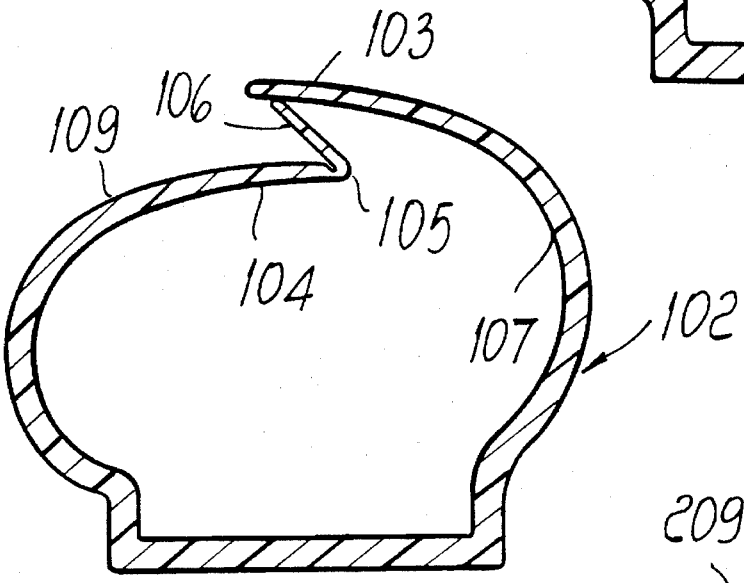
FIGS. 3 and 4 are views, similar to the preceding one, of two shells respectively according to a second and third aspects of the invention.
Figure 7:
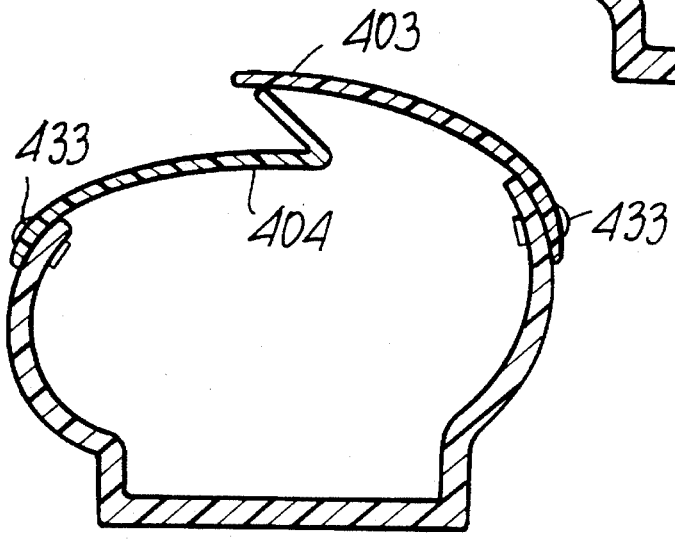

FIG. 7 illustrates a shell similar to the embodiment illustrated in FIG. 3, wherein, however, the flaps 403 and 404 are riveted to the shell by means of rivets 433.

Figure 8:
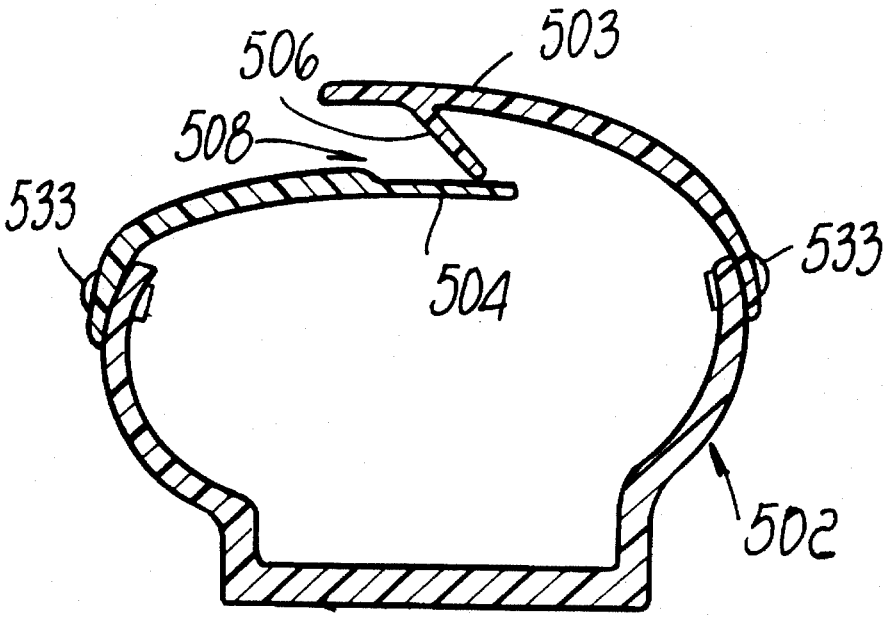

FIG. 8 illustrates a shell 502 having a first flap 503 and a second flap 504 associated therewith by means of rivets 533. The first flap 503 has a tab 506 which is adapted to be arranged in a seat 508 provided at the second flap 504, similarly to the embodiments illustrated in FIGS. 2 and 6. In this case however the tab 506 is not provided at the edge of the flap but rather at a distance therefrom.

Figure 9:
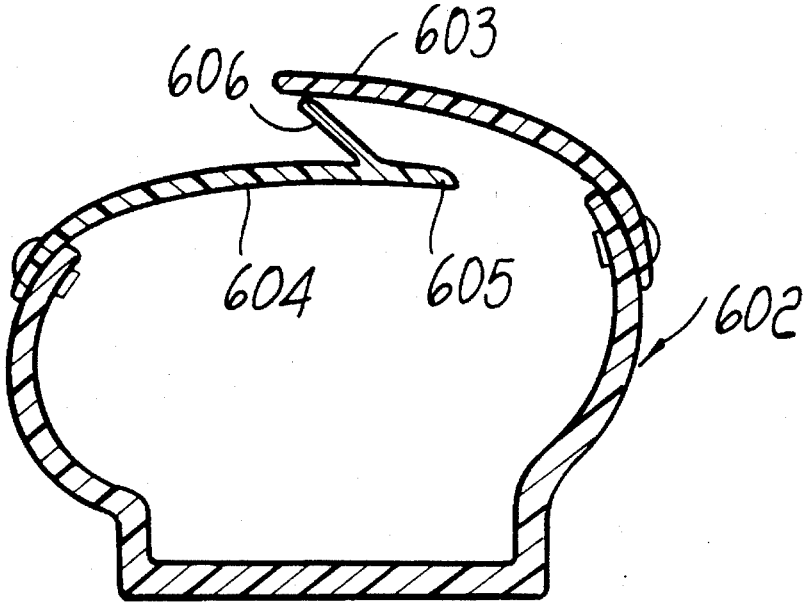

FIG. 9 illustrates a shell 602 having a first flap 603 and a second flap 604. Flap 604 has a tab 606 projecting outward and provided at a distance from the edge 605 of the second flap 604.

Figure 10:
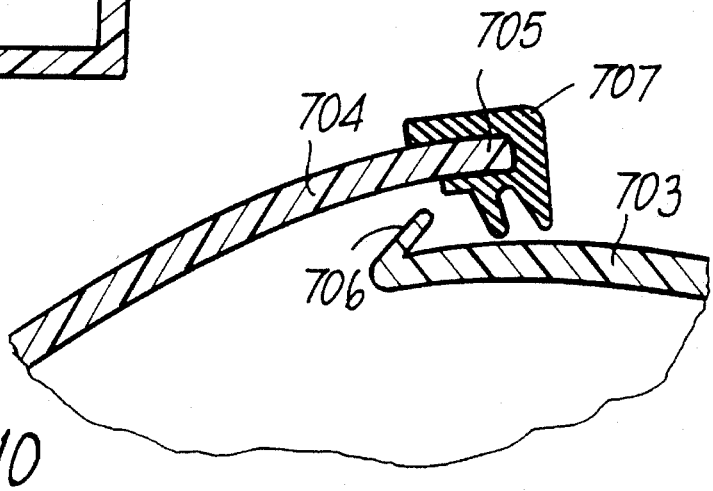
FIG. 10 is a cross section partial view of a detail of a shell according to still a further aspect of the invention.

FIG. 10 illustrate a detail of a shell having a first flap 703 and a second flap 704. The first flap 703 has an outward projecting tab 706 adapted to engage the second flap 704 in a manner similar to that of the embodiment shown in FIG. 3, for example. A border member 707, made of rubber for example, is provided at the edge 705 of the second flap 704 to improve the sealing action.

With regard to the above described embodiments, the shells each have an inside for accommodating a user's foot. The internal surfaces and external surfaces of each of the flaps face respectively towards and away from the inside of the respective shell.

As it may be appreciated from the foregoing description, in each embodiment the elastically deformable tab is connected to one of the overlapping flaps in the various manners as described, in such a manner that the tab is folded with respect to such one flap to form a fold line between the tab and the one flap, and such that the tab has an extension which forms a first angle with respect to an extension of the one flap when the flaps are relatively mutually spaced in an open position. In the embodiments as seen in FIGS. 1–3 and 5–10, the first angle formed between the extension of the tab and the extension of the flap to which the tab is connected is an acute angle, while in the embodiment seen in FIG. 4, such first angle is an obtuse angle. Moreover, the extensions of the tab and of the flap to which the tab is connected intersect, in the open position, at the fold line between the tab and the flap and the first angle formed between such extensions in the open position has a vertex which lies essentially on the fold line.

As it may be further appreciated from the foregoing description, the elastically deformable tab in each embodiment is elastically deformable such that when the first and second flaps are relatively mutually closed in a closed position the tab assumes a bent position relative to a position the tab assumed in the open position by being bent along the fold line so as to form a second angle between an extension of the flap to which the tab is connected and an extension of the tab in the closed position, and such that the extensions of the tab and of the flap to which the tab is connected in the closed position intersect at said fold line and the second angle is formed between the extensions in the closed position with a vertex of such second angle lying essentially on the fold line.

In each of the embodiments, the above described second angle is different than above described first angle. In the embodiments as seen in FIGS. 1–3 and 5–10, the first angle in the open position is greater than the second angle in the closed position, while in the embodiment seen in FIG. 4, the first angle in the open position is less than the second angle in the closed position.

As it may be further appreciated from the foregoing description of the various embodiments of the invention, the elastically deformable tab in each embodiment is connected to one flap at the above described fold line while the tab is unconnected to the other one of the overlapping flaps in the sense that it is not rigidly connected to such other flap but rather it is capable of freely sliding with respect to such other flap as the flaps are mutually relatively moved between the above described open and closed positions. In particular, in each embodiment, the free outward edge of the tab arranged distally from the fold line interacts or makes contact, in the open position of the flaps, at a contact line of an appropriate surface of the other flap to which the tab is unconnected. This interaction or contact maintains excellent sealing even when the flaps are in their open position, as described previously. However, as the flaps are mutually relatively moved from the open position into the closed position, the tab bends along the fold line resulting in the transformation of the angle formed by the extensions of the tab and of the flap to which the tab is connected, and the free outward edge of the tab is displaced with respect to the contact line as described above in the open position such that the free outward edge is arranged in a new position relative to the respective surface of the flap to which the tab is unconnected. The tab in its bent configuration in the closed position also provides an excellent sealing as described previously.

It is apparent that the tab in each of the described embodiments has such a rigidity sufficient so that the free outward edge is kept in essential contact with the contact line of the appropriate surface of the flap to which the tab is unconnected in the open position of the flaps, in order to maintain the described sealing even when the flaps are in their open position.

The materials and the dimensions constituting the individual components of the ski boot may naturally be the most pertinent according to the specific requirements.

We claim:

1. Improved watertight ski boot structure comprising;

a shell having an inside;

a first flap connected to said shell and defining a first lateral edge;

a first external lateral surface defined by said first flap and facing away from said inside of said shell;

a first internal lateral surface defined by said first flap and facing said inside of said shell;

a second flap connected to said shell, said first flap overlapping said second flap and defining a second lateral edge;

a second external lateral surface defined by said second flap and facing away from said inside of said shell and towards said first internal lateral surface of said first flap;

a second internal lateral surface defined by said second flap and facing away from said first internal lateral surface towards said inside of said shell, and;

an elastically deformable tab connected to one flap among said first flap and said second flap, said elastically deformable tab having a free outward edge being unconnected to another flap among said first flap and said second flap, said elastically deformable tab being connected to said one flap such that said tab is folded with respect to said one flap to form a fold line between said tab and said one flap and such that said tab has an extension which forms a first angle with respect to an extension of said one flap when said first and second flaps are relatively mutually spaced in an open position, the extensions of said one flap and said tab in the open position intersecting at said fold line and said first angle being formed between said extensions in the open position with a vertex of said first angle lying essentially on said fold line, and said tab being elastically deformable such that when said first and second flaps are relatively mutually closed in a closed position said tab assumes a bent position relative to a position said tab assumed in said open position by being bent along said fold line so as to form a second angle between an extension of said one flap and an extension of said tab in the closed position, the extensions of said one flap and said tab in the closed position intersecting at said fold line and said second angle being formed between said extensions in the closed position with a vertex of said second angle lying essentially on said fold line, wherein said second angle is different than said first angle and wherein said tab has a rigidity sufficient to keep said free outward edge in contact with the appropriate surface of the other flap to which the tab is unconnected in the open position of the flaps, in order to maintain sealing when the flaps are in said open position.

2. The improved watertight ski boot structure as defined in claim 1, wherein said first angle is an acute angle and wherein said second angle is less than said first angle.

3. The improved watertight ski boot structure as defined in claim 1, wherein said first angle is an obtuse angle and wherein said second angle is greater than said first angle.

4. The improved watertight ski boot structure as defined in claim 1, wherein said elastically deformable tab is connected to said lateral edge of said first flap, said elastically deformable tab being unconnected to said second flap.

5. The improved watertight ski boot structure as defined in claim 1, wherein said elastically deformable tab is connected to said lateral edge of said second flap, said elastically deformable tab being unconnected to said first flap.

6. The improved watertight ski boot structure as defined in claim 1, further comprising a seat, said seat extending along one flap among said first flap and said second flap and at least partially accommodating said elastically deformable tab in the closed position.

7. The improved watertight ski boot structure as defined in claim 6, wherein said seat extends along said second flap, and wherein said elastically deformable tab is connected to said lateral edge of said first flap, said elastically deformable tab being unconnected to said second flap and being at least partially accommodated in said seat in the closed position.

8. The improved watertight ski boot structure as defined in claim 1, wherein said first flap and said second flap are formed integrally with said shell.

9. The improved watertight ski boot structure as defined in claim 1, further comprising fixing means for connecting said first flap and said second flap to said shell.

10. The improved watertight ski boot structure as defined claim 9, wherein said fixing means for connecting said first flap and said second flap to said shell comprise rivets.

11. The improved watertight ski boot structure as defined in claim 1, further comprising a border member, said border member being connected to said other flap among said first flap and said second flap.

12. The improved watertight ski boot structure as defined in claim 1, further comprising a border member, wherein said elastically deformable tab is connected to said lateral edge of said first flap and defines an acute angle with respect to said second external lateral surface defined by said second flap, and wherein said border member is connected to said lateral edge of said second flap.

13. Improved watertight ski boot structure as defined in claim 1 wherein said elastically deformable tab is connected to said lateral edge of said first flap, said elastically deformable sealing tab being unconnected to said second flap and wherein said first angle is an acute angle and said second angle is less than said first angle.

14. Improved watertight ski boot structure as defined in claim 1 wherein said elastically deformable tab is connected to said lateral edge of said second flap, said elastically deformable sealing tab being unconnected to said first flap and wherein said first angle is an acute angle and said second angle is less than said first angle.

15. Improved watertight ski boot structure as defined in claim 1 wherein said elastically deformable tab is connected to said lateral edge of said second flap, said elastically deformable sealing tab being unconnected to said first flap and wherein said first angle is an obtuse angle and said second angle is greater than said first angle.

16. A watertight sports boot structure comprising;

a shell having an inside;

a first flap connected to said shell;

a first external surface defined by said first flap and facing away from said inside of said shell;

a first internal surface defined by said first flap and facing said inside of said shell;

a second flap connected to said shell;

a second external surface defined by said second flap and facing away from said inside of said shell;

a second internal surface defined by said second flap and facing towards said inside of said shell;

an opening defined between said first and second flaps for access to the inside of said shell, said first and second flaps being mutually relatively movable between an open position and a closed position of said first and second flaps, said opening being releasably closed when said first and second flaps are in said closed position, and said opening being open when said first and second flaps are in said open position; and an elastically deformable tab connected to one flap among said first flap and said second flap, said elastically deformable tab being connected to said one flap such that said tab is folded with respect to said one flap to form a fold line between said tab and said one flap and such that said tab has an extension which forms a first angle with respect to an extension of said one flap when said first and second flaps are relatively mutually spaced in said open position, the extensions of said one flap and said tab in the open position intersecting at said fold line and said first angle being formed between said extensions in the open position with a vertex of said first angle lying essentially on said fold line;

and said tab being elastically deformable such that when said first and second flaps are relatively mutually closed in said closed position said tab assumes a bent configuration relative to a configuration said tab assumed in said open position by being bent along said fold line so as to form a second angle between an extension of said one flap and an extension of said tab in the closed position, the extensions of said one flap and said tab in the closed position intersecting at said fold line and said second angle being formed between said extensions in the closed position with a vertex of said second angle lying essentially on said fold line, wherein said second angle is different than said first angle;

and wherein said tab has a free outward edge arranged distally from said fold line, said elastically deformable tab being unconnected to the other flap among said first flap and said second flap such that said tab is capable of freely sliding with respect to said other flap as the flaps are mutually relatively moved between said open and closed positions, and such that said free outward edge of the tab makes contact, in the open position of the flaps, at a contact line of an appropriate surface of the other flap to which the tab is unconnected in order to maintain sealing at said opening when the flaps are in said open position, and such that as the flaps are mutually relatively moved from the open position into the closed position, the tab bends along the fold line and said free outward edge of the tab is displaced with respect to said contact line until the free outward edge is arranged in a new position relative to the respective surface of the flap to which the tab is unconnected;

and wherein said tab has a rigidity sufficient to keep said free outward edge in contact with the contact line of the appropriate surface of the other flap to which the tab is unconnected in the open position of the flaps, in order to maintain sealing when the flaps are in said open position.

17. The sports boot structure of claim 16 wherein said first angle is an acute angle and wherein said second angle is less than said first angle.

18. The sports boot structure of claim 16 wherein said first angle is an obtuse angle and wherein said second angle is greater than said first angle.

19. The sports boot structure of claim 16, further comprising a seat, said seat extending along said one flap and at least partially accommodating said elastically deformable tab in the closed position.

* * * * *